US011808183B2

(12) United States Patent
Donahue et al.

(10) Patent No.: US 11,808,183 B2
(45) Date of Patent: Nov. 7, 2023

(54) SYSTEM AND METHOD FOR EXTENDING OIL LIFE IN AN ENGINE

(71) Applicant: INNIO WAUKESHA GAS ENGINES INC., Waukesha, WI (US)

(72) Inventors: Richard John Donahue, West Bend, WI (US); Owen Stewart Graham, Wales, WI (US); Kenneth Edward Neuman, Waukesha, WI (US)

(73) Assignee: INNIO WAUKESHA GAS ENGINES INC., Waukesha, WI (US)

( * ) Notice: Subject to any disclaimer, the term of this patent is extended or adjusted under 35 U.S.C. 154(b) by 0 days.

(21) Appl. No.: 17/761,442

(22) PCT Filed: May 18, 2020

(86) PCT No.: PCT/US2020/033472
§ 371 (c)(1),
(2) Date: Mar. 17, 2022

(87) PCT Pub. No.: WO2021/236056
PCT Pub. Date: Nov. 25, 2021

(65) Prior Publication Data

US 2023/0073387 A1 Mar. 9, 2023

(51) Int. Cl.
*F01M 1/16* (2006.01)
*F01M 1/02* (2006.01)
(Continued)

(52) U.S. Cl.
CPC ..... *F01M 1/16* (2013.01); *F01M 1/02* (2013.01); *F01M 3/00* (2013.01); *F01M 11/03* (2013.01);
(Continued)

(58) Field of Classification Search
CPC .. F01M 1/16; F01M 1/02; F01M 3/00; F01M 11/03; F01M 11/06; F01M 2011/007;
(Continued)

(56) References Cited

U.S. PATENT DOCUMENTS 5,511,523 A 4/1996 Masuda
2008/0202465 A1 8/2008 Allen et al.
(Continued)

FOREIGN PATENT DOCUMENTS

EP 0684368 11/1995
FR 3020093 A1 10/2015
(Continued)

OTHER PUBLICATIONS

PCT/US2020/033472; International Search Report and Written Opinion dated Aug. 4, 2020; pp. 1-8.
(Continued)

*Primary Examiner* — Yi-Kai Wang
(74) *Attorney, Agent, or Firm* — Fletcher Yoder, P.C.

(57) ABSTRACT

A system is provided. The system includes a reciprocating engine configured to consume oil at or less than 0.25 g/kw-hr and to use makeup oil. The reciprocating engine includes an engine oil sump. The system is configured to maintain an oil volume in the reciprocating engine during operation so that a residence time of oil in the reciprocating engine is at or less than 1000 hours.

20 Claims, 7 Drawing Sheets

(51) Int. Cl.

| | |
|---|---|
| ***F01M 3/00*** | (2006.01) |
| ***F01M 11/03*** | (2006.01) |
| ***F01M 11/06*** | (2006.01) |
| *F01M 11/00* | (2006.01) |

(52) U.S. Cl.
CPC ..... *F01M 11/06* (2013.01); *F01M 2011/007* (2013.01); *F01M 2011/0095* (2013.01); *F01M 2011/038* (2013.01)

(58) Field of Classification Search
CPC ..... F01M 2011/0095; F01M 2011/038; F01M 11/0004
USPC ..... 123/196 R
See application file for complete search history.

(56) References Cited

U.S. PATENT DOCUMENTS

| | | | | |
|---|---|---|---|---|
| 2009/0250019 | A1* | 10/2009 | Dahl | F01P 11/028 123/41.44 |
| 2010/0229823 | A1 | 9/2010 | Gibson et al. | |
| 2013/0312696 | A1 | 11/2013 | Mordukhovich | |
| 2016/0040622 | A1* | 2/2016 | Donahue | F16J 9/064 123/193.4 |
| 2017/0089234 | A1 | 3/2017 | Dawson et al. | |
| 2019/0024578 | A1* | 1/2019 | Sotiropoulou | F02B 1/12 |
| 2019/0359904 | A1* | 11/2019 | Johnston | C10L 1/2633 |

FOREIGN PATENT DOCUMENTS

| | | |
|---|---|---|
| GB | 1481280 A | 7/1977 |
| WO | 2015106124 | 7/2015 |

OTHER PUBLICATIONS

Barnes et al., "Paper No. 21 Oil stress investigations in Shell's medium speed laboratory engine," International Council on Combustion Engines, 2004, CIMAG Kyoto., 11 pgs.
Girshick, "Paper No. 80 Extending Oil Life in Natural Gas Engines," International Council on Combustion Engines, 2013, CIMAG Shanghai, 7 pgs.
Hengeveld et al., "A Model for Lubricant Stress in Modern Medium Speed Diesel Engines and Its Verification in a WARTSILA4L20 Laboratory Engine," 1998, CIMAG, Copenhagen, 10 pgs.
Kyrtatos, "No. 22.: Guidelines for Diesel Engines Lubrication, Oil Degradation," CIMAG, Apr. 2004, The International Council on Combustion Engines, 66 pgs.
Stark et al., "Factors Affecting Lubricant Degradation in the Piston Assembly of Gasoline Engines," STLE, 2006, Calgary, May 7-11, 2006, 50 pgs.
Taylor et al., "Engine Lubricant Trends Since 1990," 48 pgs.
Finnish Application No. 20226032, Office Action dated Jun. 13, 2023, 8 pgs.

* cited by examiner

SYSTEM AND METHOD FOR EXTENDING OIL LIFE IN AN ENGINE

CROSS-REFERENCE TO RELATED APPLICATION

This application is a National Stage entry from, and claims benefit of, PCT Application No. PCT/US2020/033472, filed on May 18, 2020; entitled "System and Method for Extending Oil Life in an Engine", which is herein incorporated by reference in its entirety.

BACKGROUND

The subject matter disclosed herein relates to reciprocating engines and, more particularly, to extending an oil life for a reciprocating engine.

A reciprocating engine (e.g., reciprocating internal combustion engine) that combusts a carbonaceous fuel, such as gasoline or diesel, distributes a lubrication oil to moving components of the engine to minimize frictional wear. Engine owners and operators try to reduce total oil usage and servicing costs by increasing the time between service by increasing oil life. Oil usage is composed of not only the oil change necessary at the end of oil life, but also oil consumption during operation. Increasing oil life increases engine availability which also improves profitability for engine owners. Oil life can be extended by increasing a total oil volume, but this does not reduce total oil usage and includes practical limitations for remote installations. Oil life can be extended using higher makeup oil rate associated with intentional increasing the oil consumption rate, which increases the sweetening ratio, but this increases total oil usage. In addition, oil additives to retard oil degradation can be effective to increase oil life but this also increases cost for oil. Therefore, there is a need for extending the service interval while reducing oil usage and cost.

BRIEF DESCRIPTION

The subject matter of this application is a system and method to reduce the cost of oil associated with operation of reciprocating engines, by substantially extending oil life of a reduced volume of oil (in comparison to known volumes of oil used today in reciprocating engines) and without increasing oil consumption of the reciprocating engine.

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system is provided. The system includes a reciprocating engine configured to consume oil at or less than 0.25 g/kw-hr and to use makeup oil. The reciprocating engine includes an engine oil sump. The system is configured to maintain an oil volume in the reciprocating engine during operation so that a residence time of oil in the reciprocating engine is at or less than 1000 hours.

In a second embodiment, an oil system connected to circulate a volume of reserve oil through a reciprocating engine is provided. The system includes an engine oil sump configured to receive the volume of reserve oil after circulating through the reciprocating engine. The system also includes an oil reconditioning circuit connected to the engine oil sump and configured to receive the volume of reserve oil exiting the engine oil sump prior to circulating the reserve oil through the reciprocating engine during operation, the oil reconditioning circuit including a deaerator to deaerate the reserve oil. The system further includes a supply of a volume of makeup oil separate from the volume of reserve oil and connected to communicate the volume of makeup oil with consumption of the volume of reserve oil during operation of the reciprocating engine, wherein the reciprocating engine configured to consume oil at or less than 0.25 g/kw-hr, and the oil system is configured to keep a residence time of oil in the reciprocating engine at or less than 1000 hours.

In a third embodiment, a method for circulating oil through a reciprocating engine which uses makeup oil is provided. The method includes operating the reciprocating engine with oil consumption at or less than 0.25 g/kw-hr. The method also includes maintaining an oil volume in the reciprocating engine during operation and using makeup oil to maintain the oil volume, wherein a residence time of oil in the reciprocating engine is at or less than 1000 hours.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
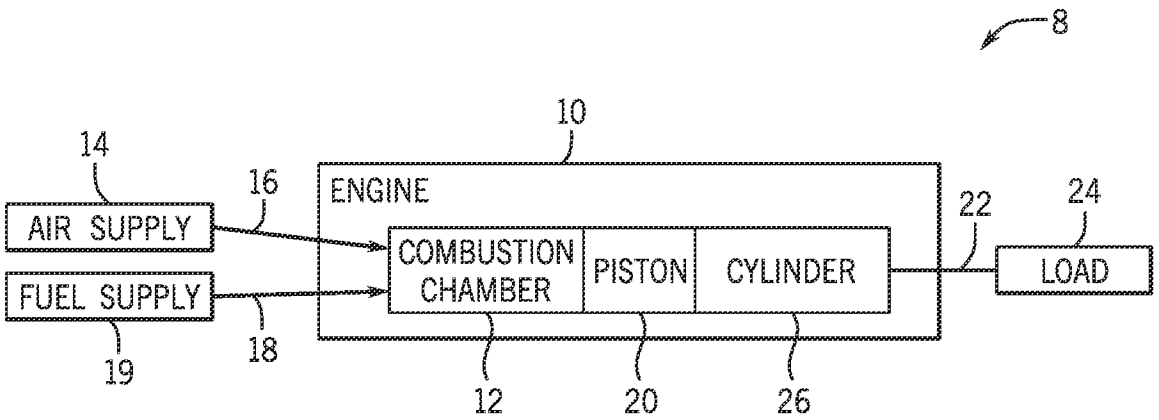
FIG. 1 is a schematic block diagram of an embodiment of a portion of a reciprocating engine system.

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure enable the extension of oil life for a reciprocating engine (e.g., reciprocating internal combustion engine). In the disclosed embodiments, the total oil volume is significantly reduced (e.g., relative to the recommended or normal oil volume that the same engine typically utilizes) to minimize the oil residence time to 1000 hours or less to extend the oil life. The oil life may be extended to achieve an infinite oil life (i.e., asymptote of oil degradation is less than a condemning limit of the oil). In particular, when minimizing the total oil volume utilized, a change in concentration between a steady-state oil concentration and makeup oil concentration is less than a condemning limit of the oil. Reducing the total oil volume and minimizing the oil residence time results in a proportional increase in makeup oil rates, which increases the sweetening ratio, enabling the oil life to be extended. In certain embodiments, the total volume of oil (e.g., reserve oil) in a sump or oil pan of the engine is reduced (e.g., relative to the sump oil volume capacity) without decreasing a head height of the reserve oil above a pickup (for providing oil to the engine) in the engine oil sump. In certain embodiments, the reserve oil may be continuously conditioned (deaerated) prior to recirculation through the engine. For example, an auxiliary circuit (e.g., oil reconditioning circuit) may be coupled to the engine oil sump that includes a deaerator and a pump (e.g., auxiliary pump). In some embodiments, the auxiliary circuit may be coupled to a main circuit (e.g., main oil circuit) having an oil pump (e.g., that operates at a higher pressure than the auxiliary pump), where the oil may be provided from the auxiliary circuit to the main circuit and, subsequently, to the engine. In other embodiments, the auxiliary circuit may be separate from the main circuit and recirculate the reserve oil between the deaerator and the engine oil sump. Minimizing the total oil volume to extend the oil life reduces oil usage, extends the service interval, and provides potential utilization with other reconditioning measures that may further extend oil life.

In the following discussion, makeup oil is defined as unused oil provided from a location (e.g., makeup oil tank) outside a reciprocating engine to the reciprocating engine. Reserve oil is defined as the oil present in an engine oil sump.

Turning to the drawings, FIG. 1 illustrates a block diagram of an embodiment of a portion of an engine driven power generation system 8. As described in detail below, the system 8 includes an engine 10 (e.g., a reciprocating internal combustion engine) having one or more combustion chambers 12 (e.g., 1, 3, 4, 5, 6, 7, 8, 10, 12, 14, 16, 18, 20, or more combustion chambers 12). In certain embodiments, the engine 10 is configured to consume oil (i.e., lose oil) at or less than 0.25 g/kw-hr and to use makeup oil. For example, the engine 10 may consume oil at or less than 0.25, 0.20, 0.15, 0.10 or 0.5 g/kw-hr. An air supply 14 is configured to provide a pressurized oxidant 16, such as air, oxygen, oxygen-enriched air, oxygen-reduced air, or any combination thereof, to each combustion chamber 14. The combustion chamber 12 is also configured to receive a fuel 18 (e.g., a liquid and/or gaseous fuel) from a fuel supply 19, and a fuel-air mixture ignites and combusts within each combustion chamber 12. The hot pressurized combustion gases cause a piston 20 adjacent to each combustion chamber 12 to move linearly within a cylinder 26 and convert pressure exerted by the gases into a rotating motion, which causes a shaft 22 to rotate. Further, the shaft 22 may be coupled to a load 24, which is powered via rotation of the shaft 22. For example, the load 24 may be any suitable device that may generate power via the rotational output of the system 10, such as an electrical generator. Additionally, although the following discussion refers to air as the oxidant 16, any suitable oxidant may be used with the disclosed embodiments. Similarly, the fuel 18 may be any suitable gaseous fuel, such as natural gas, associated petroleum gas, propane, biogas, sewage gas, landfill gas, coal mine gas, for example.

The system 8 disclosed herein may be adapted for use in stationary applications (e.g., in industrial power generating engines) or in mobile applications (e.g., in cars or aircraft). The engine 10 may be a two-stroke engine, three-stroke engine, four-stroke engine, five-stroke engine, or six-stroke engine. The engine 10 may also include any number of combustion chambers 12, pistons 20, and associated cylinders (e.g., 1-24). For example, in certain embodiments, the system 8 may include a large-scale industrial reciprocating engine having 4, 6, 8, 10, 16, 24 or more pistons 20 reciprocating in cylinders. In some such cases, the cylinders 26 and/or the pistons 20 may have a diameter of between approximately 13.5-34 centimeters (cm). In some embodiments, the cylinders 26 and/or the pistons 20 may have a diameter of between approximately 10-40 cm, 15-25 cm, or about 15 cm. In certain embodiments, the piston 20 may be a steel piston or an aluminum piston with a Ni-resist ring insert in a top ring groove of the piston 20. The system 8 may generate power ranging from 10 kW to 10 MW. In some embodiments, the engine 10 may operate at less than approximately 1800 revolutions per minute (RPM). In some embodiments, the engine 10 may operate at less than approximately 2000 RPM, 1900 RPM, 1700 RPM, 1600 RPM, 1500 RPM, 1400 RPM, 1300 RPM, 1200 RPM, 1000 RPM, 900 RPM, or 750 RPM. In some embodiments, the engine 10 may operate between approximately 750-2000 RPM, 900-1800 RPM, or 1000-1600 RPM. In some embodiments, the engine 10 may operate at approximately 1800 RPM, 1500 RPM, 1200 RPM, 1000 RPM, or 900 RPM. Exemplary engines 10 may include Waukesha Engines (e.g., Waukesha VGF, VHP, APG, 275GL), for example. Exemplary engines 10 may include Jenbacher Engines (e.g., Jenbacher Type 2, Type 3, Type 4, Type 6, Type 9), for example.

Figure 2:
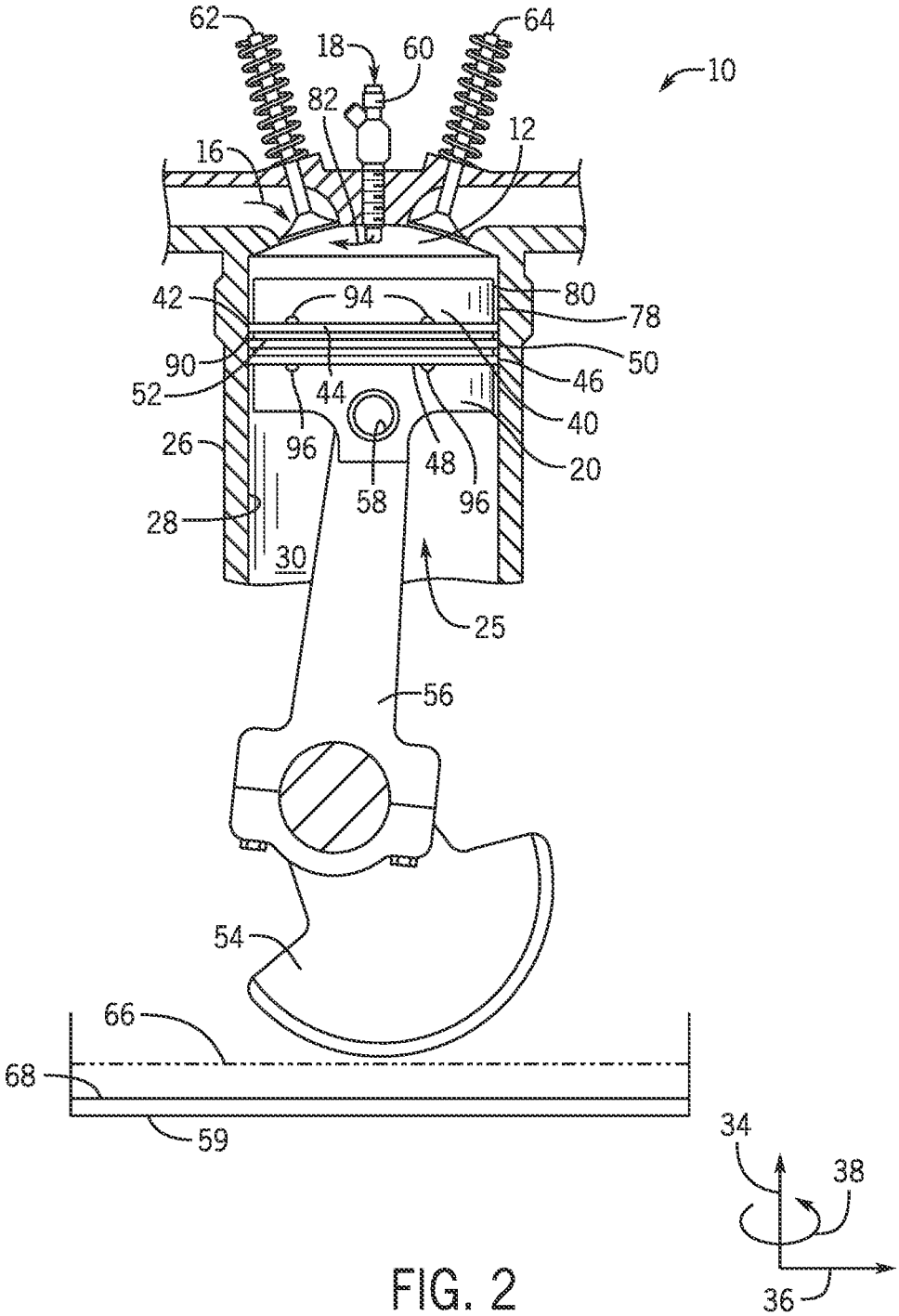
FIG. 2 is a cross-sectional view of an embodiment of a piston positioned within a cylinder.

FIG. 2 is a side cross-sectional view of an embodiment of a piston assembly 25 having a piston 20 disposed within a cylinder 26 (e.g., engine cylinder) of the reciprocating engine 10. The cylinder 26 has an inner annular wall 28 defining a cylindrical cavity 30 (e.g., bore). The piston 20 may be defined by an axial axis or direction 34, a radial axis or direction 36, and a circumferential axis or direction 38. The piston 20 includes a top portion 40 (e.g., top land) and a top annular groove 42 (e.g., top groove, top-most groove, or top compression ring groove) extending circumferentially (e.g., in the circumferential direction 38) about the piston 20. A top ring 44 (e.g., a top piston ring or a top compression ring) may be positioned in the top groove 42.

The top ring 44 is configured to protrude radially outward from the top groove 42 to contact the inner annular wall 28 of the cylinder 26. The top ring 44 generally blocks the fuel 18 and the air 16, or a fuel-air mixture 82, from escaping from the combustion chamber 12 and/or facilitates maintenance of suitable pressure to enable the expanding hot combustion gases to cause the reciprocating motion of the piston 20. Furthermore, the top ring 44 may be configured to facilitate scraping of oil, which coats the inner annular wall 28 and which controls heat and/or friction within the engine 10, for example.

As shown, the piston 20 includes a bottom annular groove 46 (e.g., bottom ring groove, bottom-most groove, or oil ring groove) extending circumferentially about the piston 20. A bottom ring 48 (e.g., bottom piston ring or oil ring) is disposed within the bottom groove 46. The oil ring 48 may protrude radially outward from the bottom groove 46 to contact the inner wall 28 of the cylinder 26. The oil ring 48 is generally configured to scrape oil that lines the inner wall 28 of the cylinder 26 and to control oil flow within the cylinder 26.

In some embodiments, one or more additional annular grooves 50 (e.g., additional ring grooves or additional compression ring grooves) may extend circumferentially about the piston 20 between from the top groove 42 and the bottom groove 46. In some embodiments, one or more additional rings 52 (e.g., additional rings or additional compression rings) may be disposed within each of the one or more additional ring grooves 50. The additional rings 52 may be configured to block blowby and/or to scrape oil from the inner annular wall 28 of the cylinder 26.

As shown, the piston 20 is attached to a crankshaft 54 via a connecting rod 56 and a pin 58. The crankshaft 54 translates the reciprocating linear motion of the piston 20 into a rotating motion. As the piston 20 moves, the crankshaft 54 rotates to power the load 24 (shown in FIG. 1), as discussed above. A sump or oil pan 59 is disposed below or about the crankshaft 54. The sump 59 is a wet sump having an oil reservoir (e.g., for reserve oil). As shown, the combustion chamber 12 is positioned adjacent to the top land 80 of the piston 20. A fuel injector 60 provides the fuel 18 to the combustion chamber 12, and an intake valve 62 controls the delivery of air 16 to the combustion chamber 14. An exhaust valve 64 controls discharge of exhaust from the engine 10. However, it should be understood that any suitable elements and/or techniques for providing fuel 18 and air 16 to the combustion chamber 12 and/or for discharging exhaust may be utilized. In operation, combustion of the fuel 18 with the air 16 in the combustion chamber 12 cause the piston 20 to move in a reciprocating manner (e.g., back and forth) in the axial direction 34 within the cavity 30 of the cylinder 26.

Present embodiments include operating the engine 10 while minimizing or reducing the total oil volume (e.g., relative to the recommended or normal oil volume that the same engine typically utilizes) to minimize the oil residence time in the engine 10 to 1000 hours or less to extend the oil life. In certain embodiments, the total oil volume in the engine 10 may be reduced to one-third, one-half, or one-quarter (or another fraction) of the normal or recommended total oil volume utilized in the same engine 10. Since less total oil volume is utilized in the engine 10, less reserve oil is present in the sump 59. Dashed line 66 represents the typical volume of reserve oil in the sump 59, while line 68 represents the reduced volume of reserve oil in the sump 59. Reducing the total oil volume and minimizing the oil residence time results in a proportional increase in makeup oil rates, which increases the sweetening ratio (i.e., the proportion of fresh oil to degraded oil; where sweetening is defined as the process of mixing fresh undegraded oil with degraded oil to improve oil properties) without increasing oil consumption (i.e., oil loss), enabling the oil life to be extended.

Figure 3:
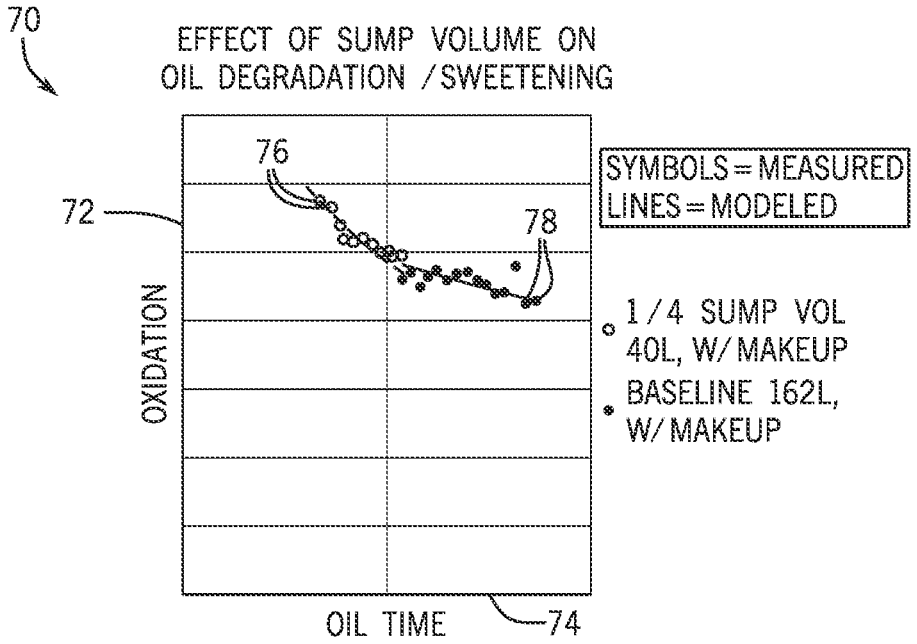
FIG. 3 is a graphical representation of the effect of sump oil volume on oil degradation/sweetening.

FIG. 3 is a graphical representation 70 of the effect of sump oil volume on oil degradation/sweetening. The y-axis 72 represents oil degradation (e.g., via oxidation) and the x-axis 74 represents oil time in a representative engine 10. Dashed lines and symbols 76 represent the data for utilizing one-quarter of the normal sump oil volume (e.g., 40 liters of oil) in the representative engine 10 and solid lines and symbols 78 represent the data for utilizing the normal sump oil volume (e.g., 162 liters of oil) in the representative engine 10. In utilizing both the reduced sump oil volume and the normal sump oil volume with the engine 10, makeup oil was also utilized. The symbols represent measured data and the lines represent modeled data for both lines and symbols 76, 78. As shown in the graphical representation 70, utilizing the reduced volume of oil results in in a higher proportional decrease in oil degradation rate and respective increase in sweetening.

The oil life may be extended to achieve an infinite oil life (i.e., asymptote of oil degradation is less than a condemning limit of the oil). In particular, when minimizing the total oil volume utilized, a change in concentration between a steady-state oil concentration and makeup oil concentration is less than a condemning limit of the oil. The concentration of degraded oil is C. Defining a control volume around the entire engine 10, the differential equation for oil degradation is as follows:

$$rV_{oil} + \sum_{inflow} Q_i C_i = \sum_{outflow} Q_j C + V_{oil}\frac{dC}{dt}. \tag{1}$$

Note that volumetric inflow is makeup oil, volumetric outflow is oil consumption, and $Q_{inflow}=Q_{outflow}=Q$. Note that the total oil volume is $V_{oil}$. Therefore, $$rV_{oil} + QC_{makeup-oil} = QC + V_{oil}\frac{dC}{dt}. \tag{2}$$

At steady state, $$\frac{dC}{dt} = 0;$$

solving for concentration at steady-state results in $$C_{steady-state} = r\frac{V_{oil}}{Q} + C_{make_oil}, \tag{3}$$

where residence time of oil in the engine 10 is defined as the ratio of total oil volume divided by the volumetric oil makeup flowrate $$\left(\frac{V_{oil}}{Q}\right).$$

As noted above, to reach an infinite oil life with utilizing less total oil volume in the engine 10, the residence time of the oil in the engine 10 is at or less than 1000 hours. In certain embodiments, the residence time of the oil in the engine 10 is at or less than 900 hours, at or less than 800 hours, at or less than 700 hours, at or less than 600 hours, or at or less than 500 hours.

Figure 4:
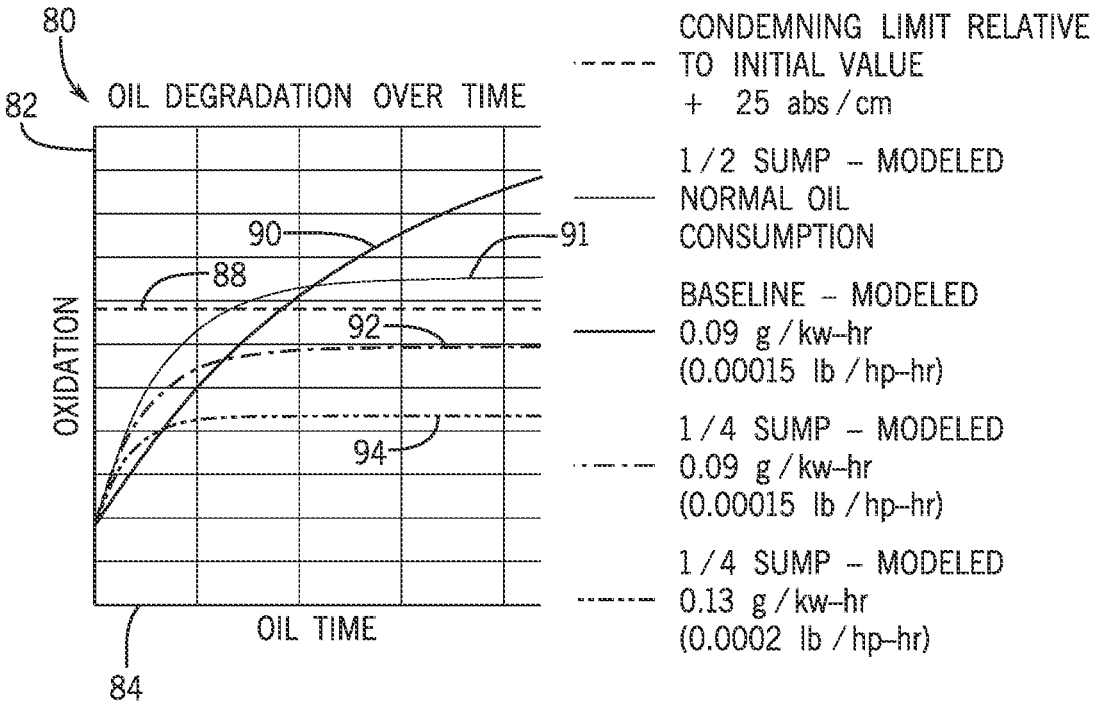
FIG. 4 is a graphical representation of the effect of sump oil volume on oil degradation over time.

FIG. 4 is a graphical representation 80 of the effect of sump oil volume on oil degradation over time. The y-axis 82 represents oil degradation (e.g., via oxidation) and the x-axis 84 represents oil time in a representative engine 10. Dashed line 88 represents the condemning line for the oil. Solid line 90 represents the data for utilizing the normal sump oil volume in the representative engine 10 at normal oil consumption. The thin solid line 91 represents the data for utilizing one-half of the normal sump oil volume in the representative engine 10 at normal oil consumption. The dash-dotted line 92 represents the data for utilizing one-quarter of the normal sump oil volume in the representative engine 10 at normal oil consumption. The dash-dash-dotted line 94 represents the data for utilizing one-quarter of the normal sump oil volume in the representative engine 10 at increased oil consumption. As shown in the graphical representation 80, when utilizing the normal sump oil volume in the representative engine 10, the level of oil degradation (as shown in line 90) continuously increases over time until the level of oil degradation surpasses the condemning limit 88. In contrast, when utilizing the reduced sump oil volume in the representative engine 10, the level of oil degradation (as shown in lines 92, 94) initially increases at a higher rate and approaches the condemning limit 88 but then flattens out (i.e., plateaus) and never surpasses the condemning limit 88 (i.e., asymptote of oil degradation is less than a condemning limit of the oil). Conventional wisdom is to increase oil life by increasing total oil volume due to reduced initial degradation rates. Contrary to conventional wisdom, reducing total oil volume to reduce residence time at or less than 1000 hours reduces the asymptotic degradation level below the condemning limit for the oil, enabling infinite oil life despite higher initial degradation rates. Reduced total oil volume reduces the amount of oil replaced at oil changes which further reduces oil cost. It should be noted that the oil degradation and condemning rate may be based on a different measurement besides oxidation (e.g., nitration or total acid number). It should be noted that for most oil metrics (e.g., oxidation, nitration, TAN), it is desired for the degradation to be below the condemning limit. However, for certain metrics (e.g., TBN), it desired for the metric to stay above the condemning limit. In certain embodiments, it is desirable for the oil metric (e.g., viscosity) to be within an acceptable range.

Figure 5:
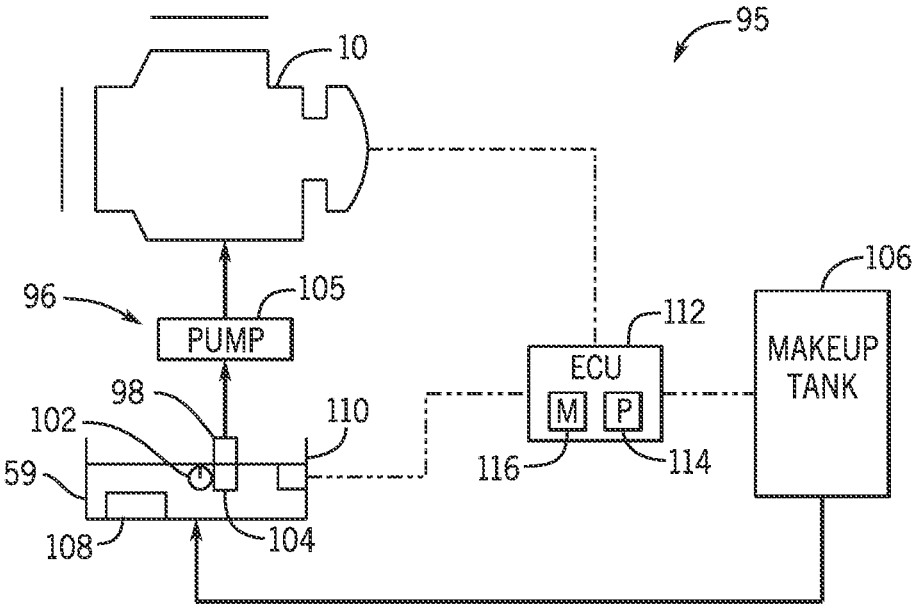
FIG. 5 is a schematic diagram of an embodiment of an oil makeup system for a reciprocating engine.

FIG. 5 is a schematic diagram of an oil makeup system 95 for the reciprocating engine 10. The engine 10 is coupled to a main oil circuit 96 that provides oil to the engine 10. The main oil circuit 96 includes a pickup 98 in the sump 59 for obtaining the oil from the sump 59 and a pump 105 (e.g., main oil pump) for moving the oil along the circuit 96 to the engine 10. With less reserve oil in the sump 59, it is desirable to keep the reserve oil level at a head height 102 above the pickup 98 in the sump 59. The head height 102 is a distance or oil level above an inlet 104 that is maintained by makeup oil provided to the sump 59 from a makeup tank 106 outside the engine 10. In certain embodiments, in order to reduce the oil volume in the sump 59 without decreasing the head height 102, one or more objects or displacements 108 may be placed in the sump 59 to displace the reserve oil in the sump 59 so that the reserve oil level is at least at the head height 102. In certain embodiments, the reserve oil that would normally be in the sump (if operating the engine 10 with the normal sump oil volume) may be located in the makeup oil tank 106 and utilized for sweetening (i.e., supplementing the oil in the engine 10). Thus, the same amount of oil is available for the engine 10 that is normally available.

One or more sensors 110 may be disposed in or adjacent the sump 59 to measure the amount of reserve oil in the sump 59. The one or more sensors 110 may include a leveler or an optical sensor. In certain embodiments, the sensors 110 may be in communication with an engine control module (ECM) or engine control unit (ECU) 112 (e.g., controller) operably coupled to communicate with the engine 10 and oil makeup system 95. In certain embodiments, based on feedback from the one or more sensors 110, the ECU 112 may provide controls signals for providing makeup oil to the sump 59 from the makeup oil tank 106 to keep the reserve oil level in the sump 59 at the head height 102. In certain embodiments, if a problem occurs with providing makeup to the sump 59, the ECU 112 may alter the operation of the engine 10 (e.g., operate the engine 10 at reduced speed, reduced load, or reduced power or shut-down the engine 10)

The ECU 112 includes a processor 114 operably coupled to a non-transitory computer readable medium or memory 116. The computer readable medium 116 may be wholly or partially removable from the ECU 112. The computer readable medium 116 contains instructions used by the processor 114 to perform one or more of the methods described herein. More specifically, the memory 116 may include volatile memory, such as random-access memory (RAM), and/or non-volatile memory, such as read-only memory (ROM), optical drives, hard disc drives, or solid-state drives. Additionally, the processor 114 may include one or more application specific integrated circuits (ASICs), one or more field programmable gate arrays (FPGAs), one or more general purpose processors, or any combination thereof. Furthermore, the term processor is not limited to just those integrated circuits referred to in the art as processors, but broadly refers to computers, processors, microcontrollers, microcomputers, programmable logic controllers, application specific integrated circuits, and other programmable circuits. The ECU 112 can receive one or more input signals ($input_1 \ldots input_n$), such as from the sensors, actuators, and other components and can output one or more output signals ($output_1 \ldots output_n$), such as to the sensors, actuators, and other components.

Figure 6:
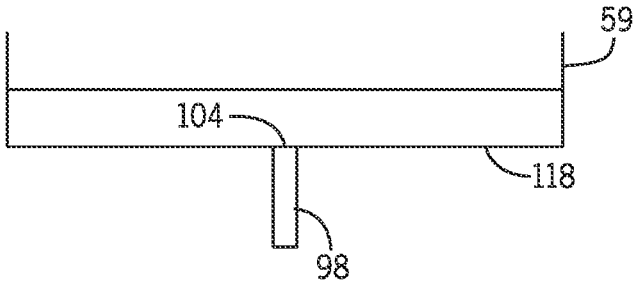
FIG. 6 is a schematic diagram of an embodiment of an engine oil sump (e.g., with pickup at bottom)
Figure 7:
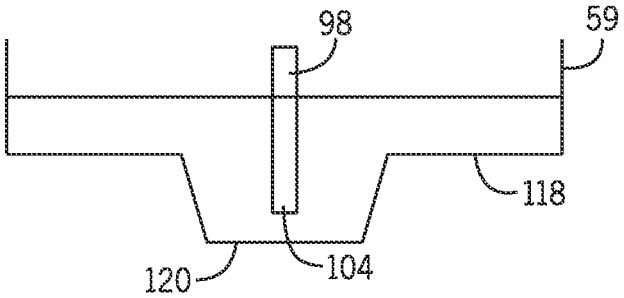
FIG. 7 is a schematic diagram of an embodiment of an engine oil sump (e.g., with a trough)

To enable operating the engine with minimum oil levels, the oil pickup may be modified. For example, as illustrated in FIG. 6, the inlet 104 of the pickup 98 may be located at a bottom 118 of the sump 59. Alternatively, as illustrated in FIG. 7, the sump 59 may be shallow but include a deep trough 120 on the bottom 118 of the sump 59 (e.g., extending away from the bottom 118). The trough includes a greater depth relative to the rest of the engine oil sump 59. The inlet 104 of the pickup 98 may be located within the trough 120 adjacent the bottom of the sump 59 to maximize the reserve oil level about the inlet 104 of the pickup 98.

As oil volume is reduced, oil aeration increases since the residence time of oil in the sump 59 is reduced (e.g., when reducing the sump oil volume to one quarter of the normal level, the residence time in the sump 59 may be also be reduced to one quarter of the normal residence time with normal sump oil volume). An oil reconditioning system 133 is provided in FIGS. 8-10. In particular, the oil reconditioning system 133 may include an auxiliary circuit 124 (e.g., oil reconditioning circuit) for deaerating (e.g., continuously deaerating) the reserve oil prior to recirculation of the oil through the engine 10. In certain embodiments, the auxiliary circuit 124 may be selectively utilized. The deaeration of the reserve oil enables a lower total oil volume to be utilized in the engine 10 and extension of the oil life. Although deaeration is discussed, other forms of reconditioning the oil (e.g., adding additives) may be incorporated along the auxiliary circuit 124 or form part of a separate circuit.

Figure 8:
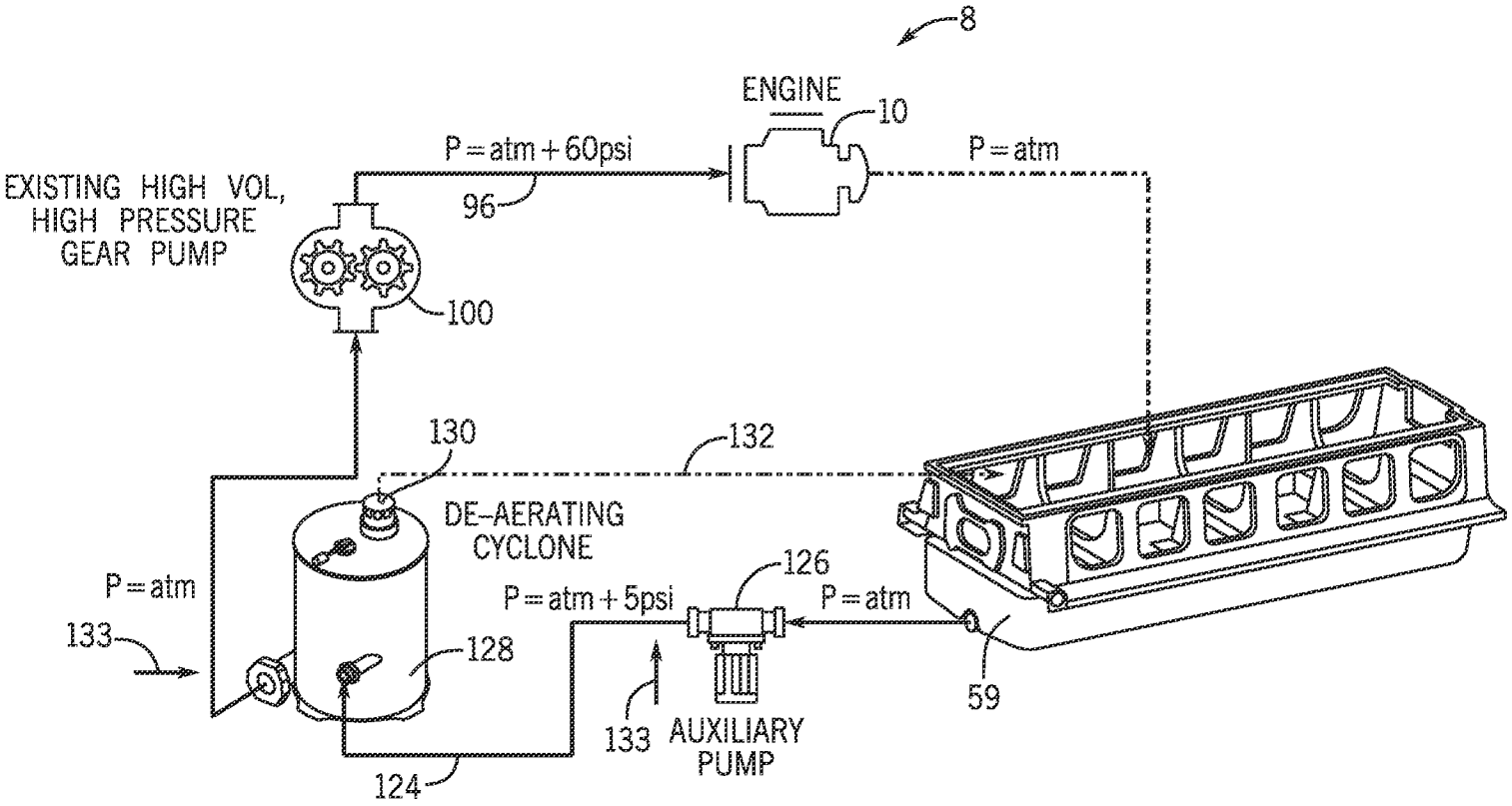
FIG. 8 is a schematic diagram of an embodiment of a reciprocating engine system with a main oil circuit and an auxiliary circuit (e.g., with the auxiliary circuit coupled to the main oil circuit)

FIG. 8 is a schematic diagram of an embodiment of the reciprocating engine system 8 with the main oil circuit 96 and the auxiliary circuit 124. As described above, the main oil circuit 96 includes the main oil pump 100 disposed along it to provide the oil to the engine 10. The auxiliary circuit 124 includes a pump 126 (e.g., auxiliary pump) and a deaerator 128 disposed along the circuit 124. The pump 100 operates at a greater pressure than the pump 126. The auxiliary circuit 124 is coupled to or in-line with the main oil circuit 96. As depicted, the deaerator 128 is a deaerating cyclone. In certain embodiments, another device (e.g., having an impeller) may be utilized for the deaerator 128. As depicted, reserve oil is pumped along the circuit 124 via the pump 126 to the deaerator 128. The pump 126 may receive the oil from the sump 59 at atmospheric pressure and discharge the oil to the deaerator 128 at slightly greater than atmospheric pressure (e.g., approximately 5 psi (34.5 kPa) more than atmospheric pressure). In certain embodiments, the deaerator 128 may be utilized to deaerate the reserve oil to below approximately 20 percent oil aeration (plus or minus 1 percent). The deaerator 128 includes a vent 130 that discharges air back to the sump 59 via line 132. The deaerator 128 discharges the oil at atmospheric pressure along the main oil circuit 96. The oil pump 100 receives the oil at atmospheric pressure and discharges the oil at a higher pressure (e.g., approximately 60 psi (413.7 kPa) more than atmospheric pressure) to the engine 10. In certain embodiments, one or more sensors may be disposed along different points along the circuits 96, 124 to measure the aeration of the oil as indicated by arrows 133. The sensors may be in communication with the ECU 112. In certain embodiments, the ECU 112 may regulate the deaeration of the reserve oil.

Figure 9:
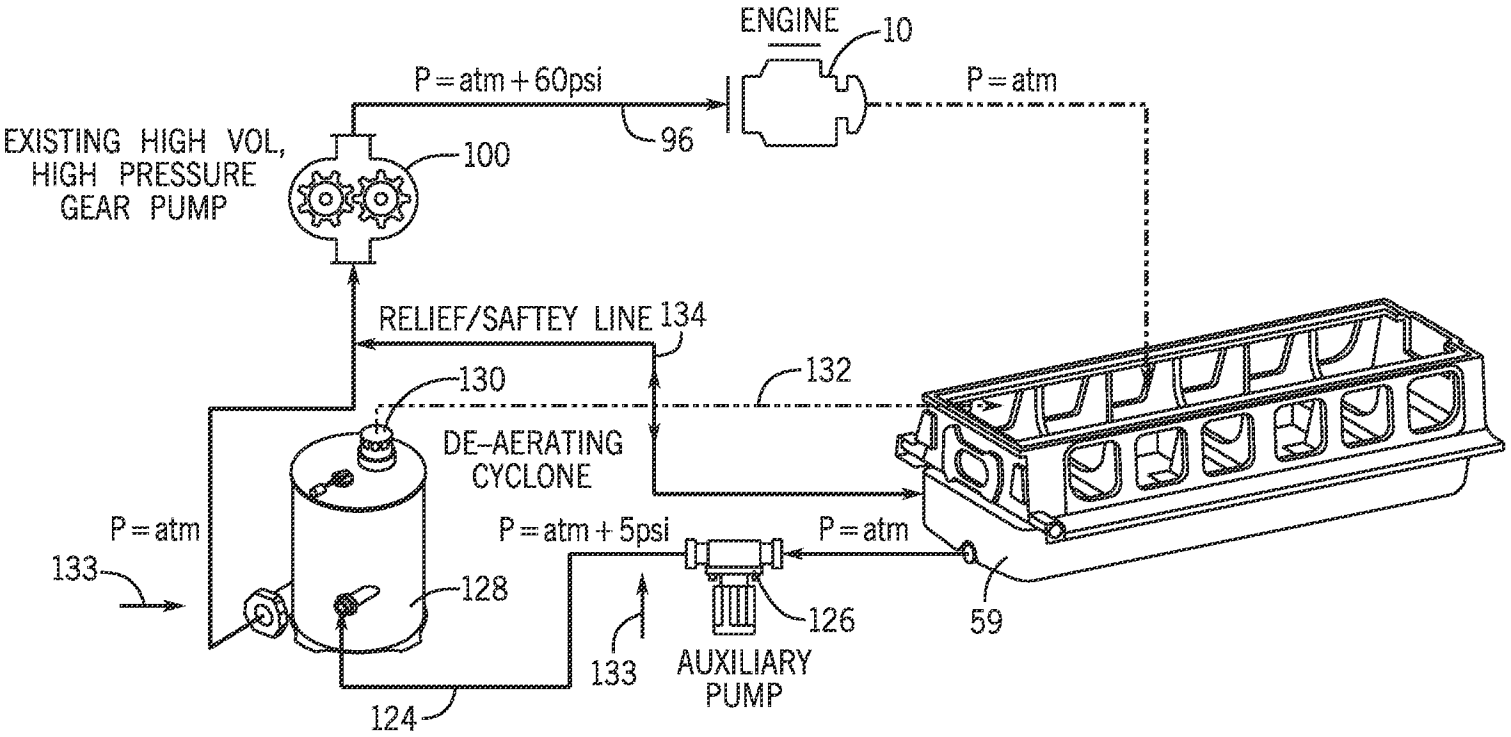
FIG. 9 is a schematic diagram of an embodiment of a reciprocating engine system with a main oil circuit and an auxiliary circuit (e.g., with a bidirectional relief/safety line)

FIG. 9 is a schematic diagram of an embodiment of the reciprocating engine system 8 with the main oil circuit 96 and the auxiliary circuit 124 with a bidirectional relief/safety line 134. The main oil circuit 96 and the auxiliary circuit 124 are as described above in FIG. 8 with one exception. The reciprocating engine system 8 includes the bidirectional relief/safety line 134 extending between the sump 59 and a meeting point between the circuits 96, 124. In certain embodiments, when conditions warrant not utilizing the auxiliary circuit 124 (e.g., when an issue exists with the pump 126 and/or the aerator 128), the reserve oil may be directly provided to the main oil circuit 96 upstream of the pump 100 via the bidirectional relief/safety line 134. In certain embodiments, where an issue exists with the engine 10 or the pump 100, deaerated oil may be recirculated back to the sump 59 via the bidirectional relief/safety line 134.

Figure 10:
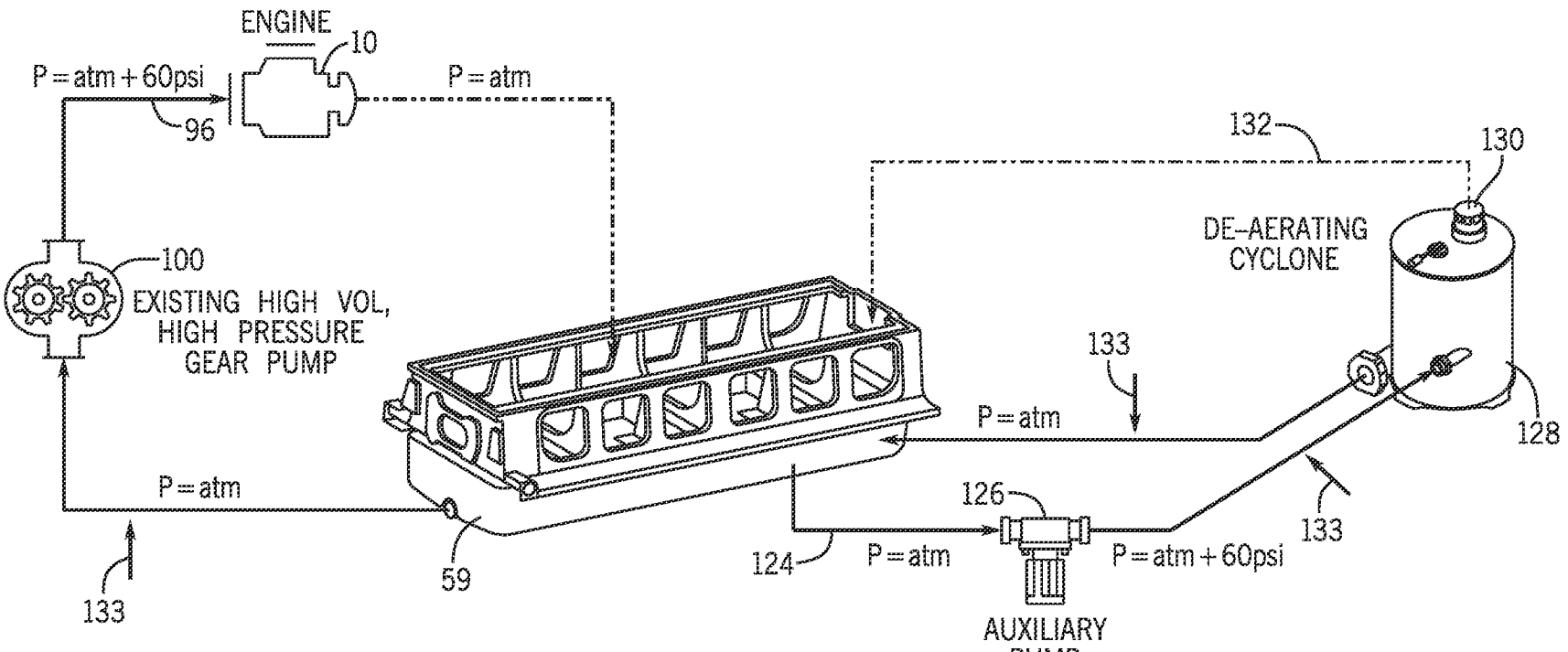
FIG. 10 is a schematic diagram of an embodiment of a reciprocating engine system with a main oil circuit and auxiliary circuit (e.g., with the auxiliary circuit separate from the main oil circuit).

FIG. 10 is a schematic diagram of an embodiment of the reciprocating engine system 8 with the main oil circuit 96 and the auxiliary circuit 124 with the auxiliary circuit 14 separate from the main oil circuit 96. The main oil circuit 96 and the auxiliary circuit 124 are as described above in FIG. 8 with one exception. The auxiliary circuit 124 is separate from the main oil circuit 96. Thus, the deaerated reserve oil is discharged from the deaerator 128 to the sump 59 along the auxiliary circuit 124.

Oil condemning limits vary based on engine manufacturer and engine type (e.g. gasoline, diesel, natural gas). Condemning limits are typically based on metrics for oxidation, nitration, total base number (TBN), total acid number (TAN), and viscosity. Representative condemning limits for oil are as follows in TABLE I:

TABLE I

| Analysis Metric | Standard Test Method | Condemning Limit |
|---|---|---|
| Oxidation and/or | ASTM E2412 Annex A1 | 25abs/cm rise relative to unused oil of same formulation |
| Nitration | ASTM E2412 Annex A2 | 40abs/cm rise relative to unused oil of same formulation |
| TAN | ASTM D664 | 3.0 point rise relative to unused oil of same formulation |
| TBN | ASTM D2896 | 50% decrease relative to unused oil of same formulation |
| Viscosity (40° C.) and (100° C.) | ASTM D445 | −20%/+30% change relative to unused oil of same formulation |

Oil aeration is defined as the total gas contained in the oil. Aeration is composed of both entrained gas (i.e. dissolved gas) and free gas (i.e. bubbles). Aeration will be defined as the total gas volume measured at a pressure of 105 pa, and temperature of 273K based on the Henry-Dalton Law using a Bunsen coefficient of 0.10 for oil.

Technical effects of the disclosed embodiments include providing systems and methods for the extension of oil life for a reciprocating engine (e.g., reciprocating internal combustion engine) that consumes oil at or less than 0.25 g/kw-hr and uses makeup oil. In the disclosed embodiments, the total oil volume is significantly reduced (e.g., relative to the recommended or normal oil volume that the same engine typically utilizes or the oil volume capacity) to minimize the oil residence time to 1000 hours or less to extend the oil life. Reducing the total oil volume and minimizing the oil residence time results in a proportional increase in makeup oil rates, which increases the sweetening ratio, enabling the oil life to be extended. In certain embodiments, the reserve oil may be continuously conditioned (deaerated) prior to recirculation through the engine. Minimizing the total oil volume to extend the oil life reduces oil usage, extends the service interval, and provides potential utilization with other reconditioning measures that may further extend oil life. This may result in a costs savings to the operator of the engine and benefits the environment.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112 (f).

The invention claimed is:

1. A system, comprising:

a reciprocating engine configured to consume oil at or less than 0.25 g/kw-hr and to use makeup oil, wherein the reciprocating engine comprises an engine oil sump, wherein the system is configured to maintain an oil volume in the reciprocating engine during operation so that a residence time of oil in the reciprocating engine is at or less than 1000 hours.

2. The system of claim 1, comprising an oil reconditioning circuit coupled to the reciprocating engine and configured to deaerate reserve oil in the engine oil sump prior to recirculating the reserve oil through the reciprocating engine, wherein the oil conditioning system is coupled to the engine oil sump and comprises a deaerator to deaerate the reserve oil.

3. The system of claim 2, wherein the deaerator is configured to deaerate the reserve oil below approximately 20 percent oil aeration during operation of the reciprocating engine.

4. The system of claim 1, wherein a degradation of the oil has a stable level that does not exceed a condemning limit of the oil.

5. An oil system connected to circulate a volume of reserve oil through a reciprocating engine, comprising:

an engine oil sump configured to receive the volume of reserve oil after circulating through the reciprocating engine;

an oil reconditioning circuit connected to the engine oil sump and configured to receive the volume of reserve oil exiting the engine oil sump prior to circulating the reserve oil through the reciprocating engine during operation, the oil reconditioning circuit including a deaerator to deaerate the reserve oil; and a supply of a volume of makeup oil separate from the volume of reserve oil and connected to communicate the volume of makeup oil with consumption of the volume of reserve oil during operation of the reciprocating engine, wherein the reciprocating engine configured to consume oil at or less than 0.25 g/kw-hr, and the oil system is configured to keep a residence time of oil in the reciprocating engine at or less than 1000 hours.

6. The system of claim 5, comprising a main circuit coupled to the engine oil sump and configured to enable flow of reserve oil to the reciprocating engine, wherein the main circuit comprises a main oil pump disposed along the main circuit.

7. The system of claim 6, wherein the main circuit is connected separately to the engine oil sump from connection of the oil reconditioning circuit to the engine oil sump.

8. The system of claim 6, wherein the main circuit is coupled in series with the oil reconditioning circuit to the engine oil sump.

9. The system of claim 8, comprising a bypass circuit coupled to the main circuit, wherein the bypass circuit is configured to selectively open the flow of the reserve oil directly from the engine oil sump to the main circuit.

10. The system of claim 6, wherein the oil conditioning system comprises an auxiliary pump to pump the reserve oil from the engine oil sump to the deaerator.

11. The system of claim 10, wherein the main oil pump is configured to operate at a higher pressure than the auxiliary pump.

12. The system of claim 5, wherein a degradation of the oil has a stable level that does not exceed a condemning limit of the oil.

13. The system of claim 5, wherein the deaerator is configured to deaerate the reserve oil below approximately 20 percent oil aeration during operation of the reciprocating engine.

14. A method for circulating oil through a reciprocating engine which uses makeup oil, comprising:

operating the reciprocating engine with oil consumption at or less than 0.25 g/kw-hr; and maintaining an oil volume in the reciprocating engine during operation and using makeup oil to maintain the oil volume, wherein a residence time of oil in the reciprocating engine is at or less than 1000 hours.

15. The method of claim 14, wherein operating the reciprocating engine comprises operating the reciprocating engine with less reserve oil in the engine oil sump of the reciprocating engine than an oil sump volume capacity of the engine oil sump without decreasing a head height of the reserve oil above a pickup in the engine oil sump.

16. The method of claim 14, comprising communicating reserve oil in an engine oil sump of the reciprocating engine through an oil reconditioning circuit coupled to the engine oil sump, wherein the oil conditioning circuit comprises a deaerator to deaerate the reserve oil.

17. The method of claim 16, comprising deaerating the reserve oil, via the deaerator, to below approximately 20 percent oil aeration.

18. The method of 16, comprising communicating the reserve oil from the engine oil sump of the reciprocating engine through a main circuit coupled to the reciprocating engine, wherein the main circuit comprises a main oil pump disposed along the main circuit.

19. The method of claim 18, comprising communicating the reserve oil directly from the engine oil sump to the reciprocating engine via the main circuit separate from the oil reconditioning circuit.

20. The method of claim 18, comprising communicating the reserve oil directly from the engine oil sump to the reciprocating engine via the main circuit coupled to the oil reconditioning circuit.

* * * * *